US006074480A

United States Patent [19]

Kakuta

[11] Patent Number: 6,074,480

[45] Date of Patent: Jun. 13, 2000

[54] METHOD AND DEVICE FOR THE COATING OF ADHESIVES

[75] Inventor: Watura Kakuta, Kanagawa, Japan

[73] Assignee: Nordson Corporation, Westlake, Ohio

[21] Appl. No.: 09/057,185

[22] Filed: Apr. 8, 1998

[30] Foreign Application Priority Data

Apr. 9, 1997 [JP] Japan ..... 9-090798

[51] Int. Cl.[7] ..... B05D 1/28; B05C 1/08

[52] U.S. Cl. ..... 118/249; 118/258; 427/208.6; 427/256; 427/428

[58] Field of Search ..... 156/324, 555; 118/248, 249, 419, 258; 427/207.1, 208.4, 208.6, 256, 428

[56] References Cited

U.S. PATENT DOCUMENTS

| | | | |
|---|---|---|---|
| 4,503,802 | 3/1985 | Keller et al. | 118/249 |
| 4,524,712 | 6/1985 | Ito | 118/46 |
| 4,569,864 | 2/1986 | McIntyre | 427/428 |
| 4,706,601 | 11/1987 | Jahn | 118/46 |
| 5,028,457 | 7/1991 | Kinose et al. | 427/258 |
| 5,101,759 | 4/1992 | Hefele | 118/202 |
| 5,275,656 | 1/1994 | Jendroska | 118/46 |

*Primary Examiner*—James Sells
*Attorney, Agent, or Firm*—Calfee, Halter & Griswold LLP

[57] ABSTRACT

A method and apparatus is provided to enable the transfer coating of an elaborate and fine pattern of hot melt adhesive onto a workpiece, and to extend the service life of the first roll and the doctor blade. A predetermined pattern of hollows is provided on the surface of a first roll which is partially immersed and rotatably mounted in a tank of adhesive. A second roll which is in rotatable contact with the first roll, has a pattern of protrusions provided on its surface of the second roll that differs from that on the first roll. By this approach, the adhesive is transferred only to the protrusions of said second roll even if excess adhesive remains in the hollows of the first roll and even if some adhesive remains in areas other than the hollows. Accordingly, a necessary and sufficient amount of adhesive can be transferred onto the workpiece without the simultaneous transfer of any stains. In this way, an elaborate, fine, and clear pattern without any spreading and/or loss of shape can be obtained. Furthermore, there is no need to intensively scrape excess adhesive off the surface of the first roll with the doctor blade, which in turn allows the force used to press the doctor blade against the first roll to be reduced, the result being an extension of service life for both the first roll and the doctor blade.

7 Claims, 4 Drawing Sheets

METHOD AND DEVICE FOR THE COATING OF ADHESIVES

TECHNICAL FIELD OF THE INVENTION

This application claims the benefit of foreign priority under 35 USC 119 of Japanese Patent Application No. 9[1997]-90,798 filed on Apr. 9, 1997. The present invention pertains generally to a roll transfer coating method and apparatus for applying adhesive materials, such as for bonding together flexible articles such as the inner lining of a car compartment, or articles of clothing as represented by diapers for infants. More particularly, the invention pertains to an adhesive coating method and apparatus that involves continuously applying adhesives by a roll transfer coating process to the bonding surface of flexible base materials while forming a predetermined pattern.

BACKGROUND OF THE INVENTION

Conventional methods for applying an adhesive in various patterns on a moving workpiece by roll transfer would include the method disclosed in Japanese Kokai No. 3[1991]-90,602. This conventional method uses the device shown in FIG. 1 and is briefly described for illustrative purposes. In FIG. 1, a hot melt adhesive 27 is stored in a tank 30 in which a first roll 31 is partially immersed. As the first roll 31 rotates, the adhesive 27 adheres to the surface of a first roll 31 which has a predetermined pattern formed as hollows on the surface. Next, an excess of the adhesive on the surface of the first roll 31 is scraped off by a doctor blade 35, such that just enough of the adhesive remains to fill up the hollows.

To continue, the adhesive left only in the hollows of said first roll 31 is transferred to the surface of a second roll 32 that has a smooth uneven surface. At this point, a workpiece 7*a* is moved into contact with said second roll 32 while under pressure exerted by a pressure roll 36, and in this way the adhesive is transferred from the surface of the second roll 32 to the surface of the workpiece 7*a* in the form of a predetermined pattern.

There is a disadvantage in the above-mentioned conventional technique of the pattern spreading because of the mutual pulling of the adhesive in the hollows of the first roll 31, or when the predetermined pattern is very fine and detailed, of the pattern becoming interconnected with itself and then transferred to the workpiece as a stain. Moreover, whenever the adhesive adheres to areas other than the hollows on the surface of the first roll 31, the adhesive will end up adhering to the surface of the workpiece 7*a* as a stain. To avoid these problems, it has been necessary to press a doctor blade 35 against the first roll with considerable force in order to scrape off the excess adhesive on the surface of the first roll 31. As a result, the first roll 31 and doctor blade 35 are subject to extreme wear, thus their service life is short.

Furthermore, the possibility of smearing or spreading the pattern increases as the pattern becomes finer and more elaborate. In this situation, it becomes necessary to more precisely scrape the adhesive off the surface of the first roll 31 in order to avoid the spreading or smearing mentioned above, so the force under which the doctor blade 35 is pressed against the first roll 31 is generally increased. As a result, the service life of the first roll 31 and doctor blade 35 is shortened even more. What is more, in situations like this, it becomes difficult to keep the amounts of adhesive required for transfer in the hollows because of the scraping. Accordingly, in some cases the pattern becomes thinned down to the point that fine and/or elaborate details can no longer be transferred.

Furthermore, the second roll, which in most cases is typically made of silicon rubber, is a roll with a flat surface. Because of this, only the pattern portion consisting of the adhesive that adheres to the silicone rubber surface of the second roll, peels off in a thickness of the order of angstroms as the adhesive is transferred to the surface of the workpiece. However, the peeled amount increases and hollows are formed on the second roll as the transfer is repeated. This is because the adhesive gets into these hollows, so that a sufficient amount of adhesive can no longer be provided on the workpiece; thus, there is the possibility of early failure of transfer coating.

It is therefore desirable to provide a method and an apparatus to obtain a more elaborate and finer pattern that remains clear without losing its shape, to prevent stains from adhering to the workpiece, and to extend the life of the first roll, the doctor blade, and the second roll in the above-mentioned method for the roll transfer coating of adhesives.

SUMMARY OF THE INVENTION

The invention provides in one aspect a method for applying an adhesive comprising the step of filling with adhesive the hollows of a patterned outer surface of a first roll; transferring the adhesive from the hollows of said first roll onto the surface of a second roll when said second roll is brought into contact with said first roll, with the second roll surface having patterned protrusions, and transferring the adhesive from said protrusions of said second roll to the surface of a workpiece while said second roll is brought into contact under pressure with said workpiece.

The invention provides in another aspect a method for applying an adhesive comprising the step of filling with adhesive the hollows of a patterned outer surface of a rotating first roll; transferring the adhesive from the hollows of said first roll onto the surface of a rotating second roll when said second roll is brought into contact with said first roll, said second roll surface having protrusions of a different pattern than said first roll, and transferring the adhesive from said protrusions of said second roll to the surface of a workpiece to be coated by moving said workpiece while said second roll is brought into contact under pressure with said workpiece.

The invention provides in yet another aspect a device for applying an adhesive comprising: a tank for holding an adhesive, a first roll rotatably mounted and partially immersed in said tank, said first roll having a surface on which the hollows of a pattern are formed; a second roll having a surface on which patterned protrusions are formed, said second roll being rotatably mounted with the protrusions positioned for contact with said surface of said first roll; and a pressure roll for moving a workpiece and pressing said workpiece into contact with said patterned protrusions of said second roll wherein the patterned adhesive is transferred to the workpiece.

The invention provides in still another aspect a device for applying an adhesive, comprising: means for applying an adhesive to the hollows of an outer patterned surface of a first roll; a second roll having an outer surface on which patterned protrusions are formed the second roll positioned for transferring adhesive from said first roll surface to said patterned protrusions on the second roll, and means for transferring adhesive from said protrusions of said second roll surface to said workpiece.

These and other aspects of the present invention will be readily understood and appreciated by those skilled in the art from the following detailed description of the preferred embodiments with the best mode contemplated for practicing the invention in view of the accompanying drawings.

EXPLANATION OF THE SYMBOLS (1) first roll (coater roll); (1*a*) pattern of hollows on the first roll, (2) second roll (transfer roll); (2*a*) pattern of protrusions on the second roll; (2*b*) pattern of protrusions on the second roll, (3) tank; (4) hot melt adhesive; (5) doctor blade; (6) pressure roll; (7) workpiece; (8) material to be joined; and (9) nip roll.

DETAILED DESCRIPTION OF THE INVENTION

Figure 1:
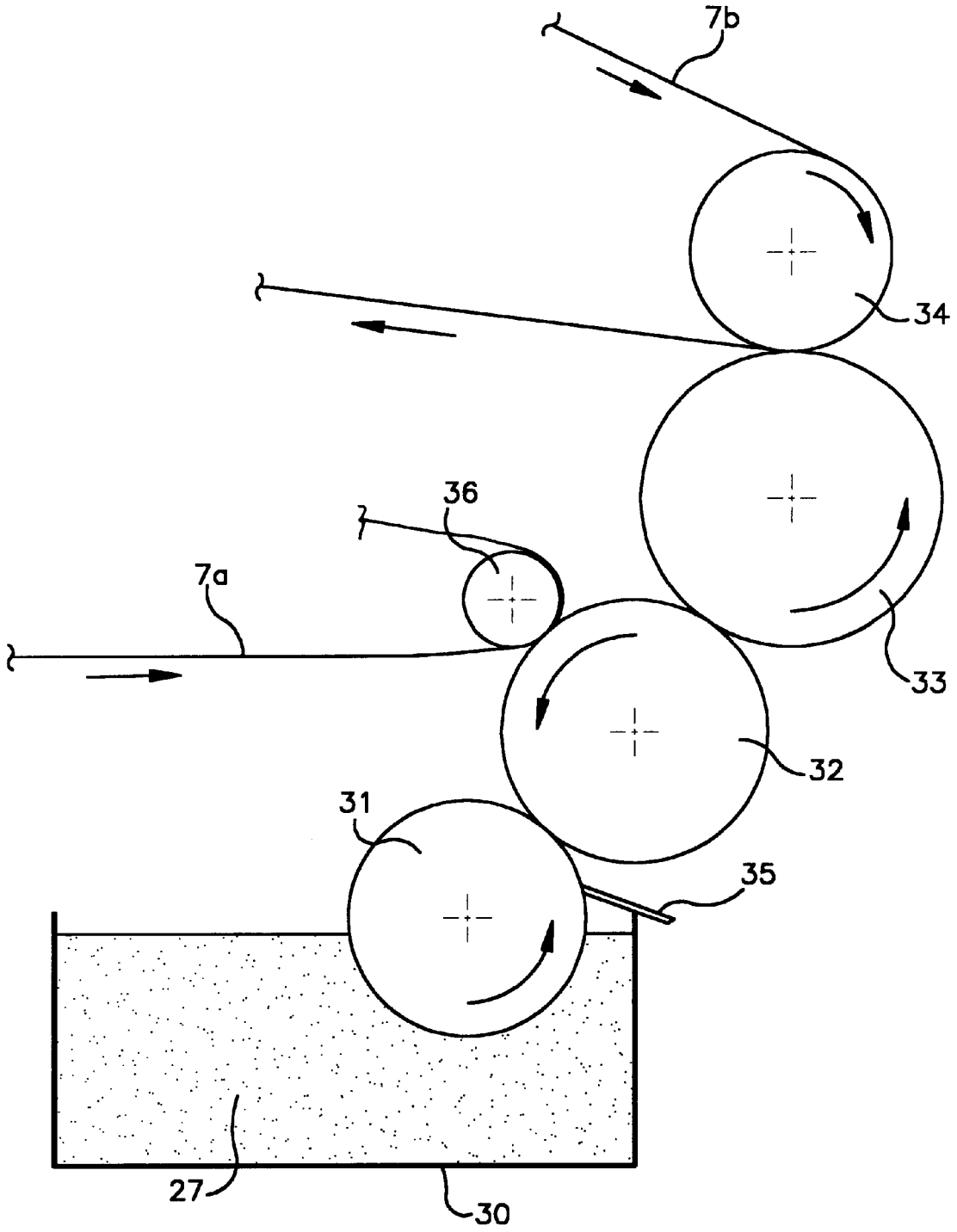
Fig.1 (PRIOR ART )
FIG. 1 is a schematic side view of the adhesive coating device according to the conventional technique.
Figure 3:
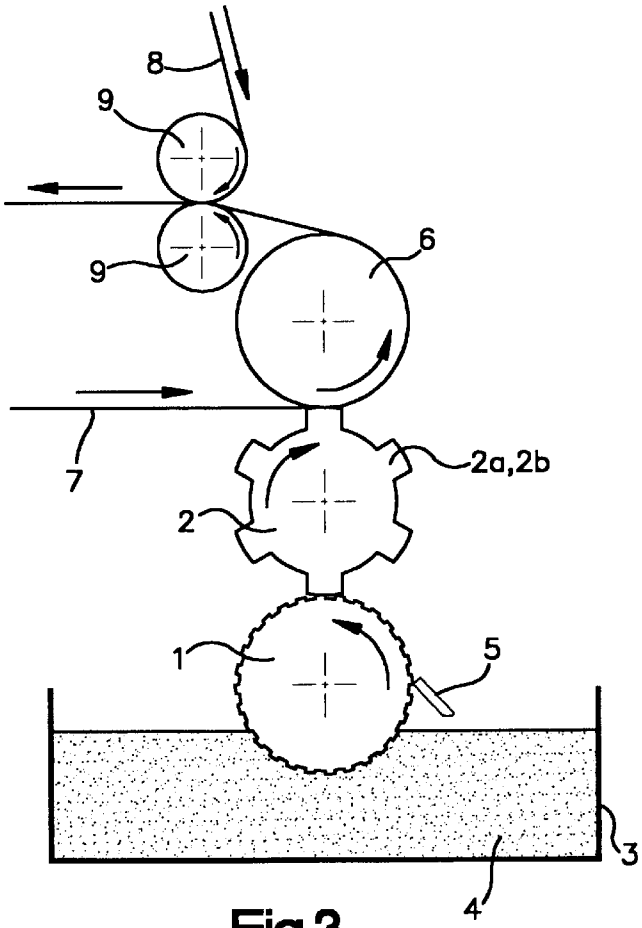
FIG. 3 is a schematic side view of the adhesive coating device according to the present invention.
Figure 2:
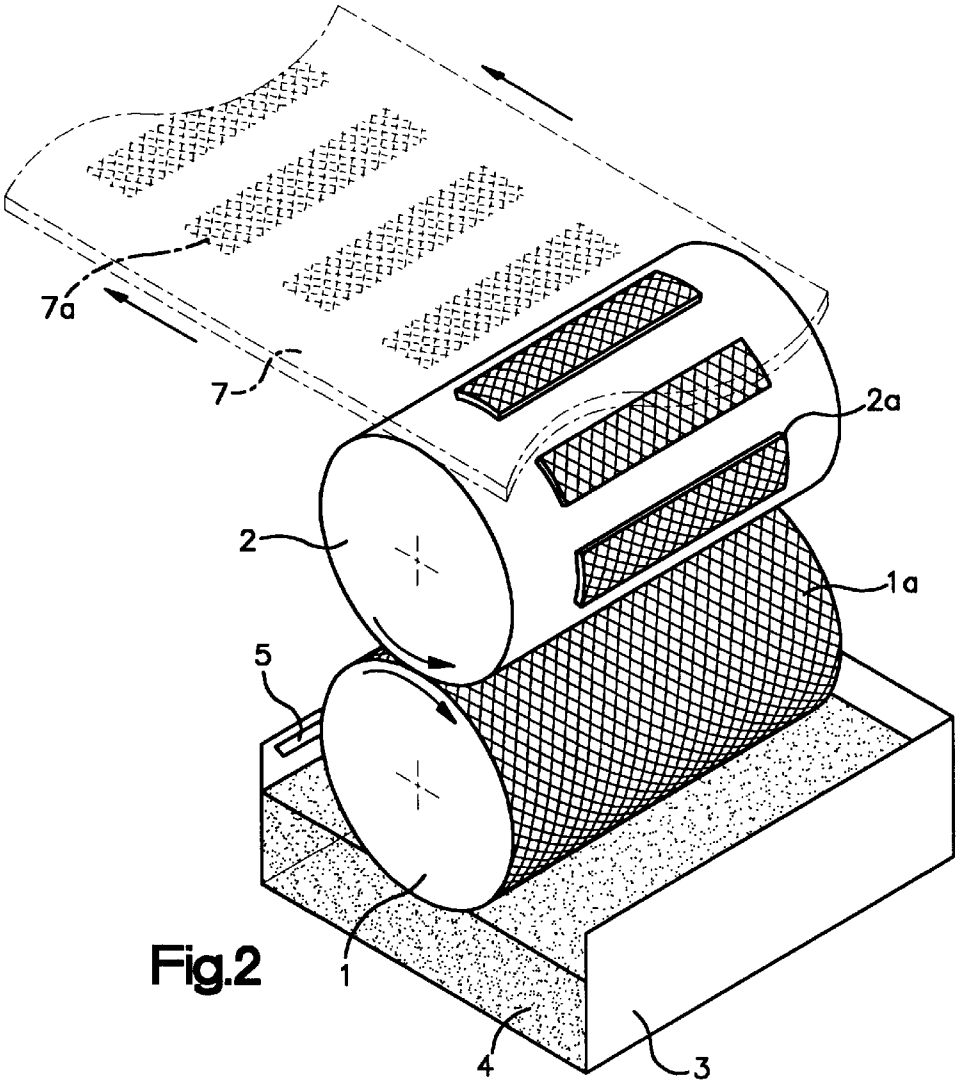
FIG. 2 is a schematic perspective view of the adhesive coating device according to the present invention.
Figure 4:
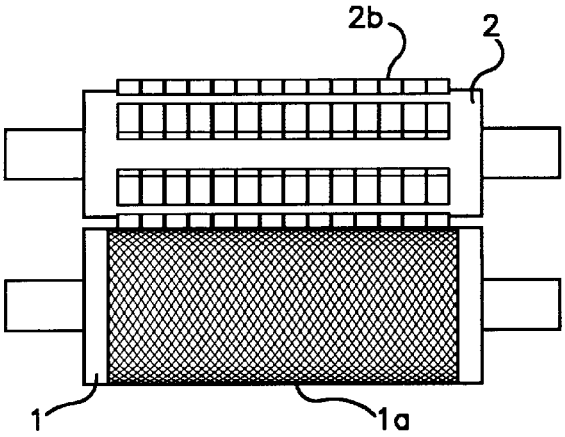
FIG. 4 is a front view of the first roll (coater roll) and the second roll (transfer roll)
Figure 5:
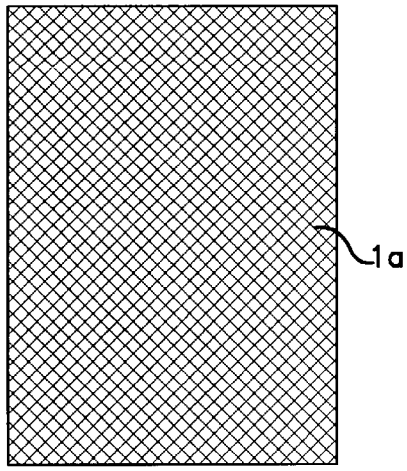
FIG. 5 is a diagram which shows the pattern of hollows formed on the surface of the coater roll.
Figure 6:
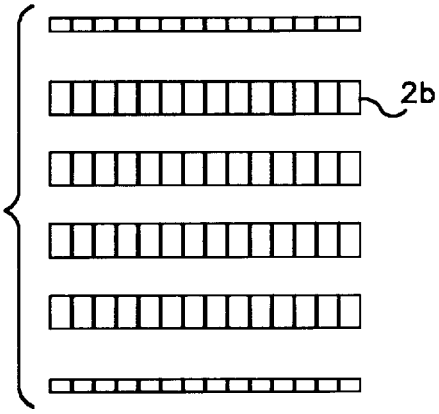
FIG. 6 is a diagram which shows the pattern of protrusions formed on the surface of the transfer roll.

In FIG. 2, a hot melt adhesive 4 is placed in a tank 3, in which a first roll 1 is partially immersed and rotatably mounted therein. As the first roll 1 rotates, adhesive adheres to the surface of the first roll 1 on which a net-like first pattern 1*a* as shown in FIG. 5 has been formed as a pattern of hollows. Any excess of the adhesive 4 that remains on the surface of the first roll 1 is scraped off by a doctor blade 5, leaving the adhesive only in the hollows of the pattern 1*a*. Long and narrow rectangular patterns of protrusions 2*a* are axially aligned along the second roll 2 as shown in FIG. 2, and are formed on the surface of the second roll 2 as a second pattern. Alternatively, additional patterns of protrusions 2*b* that comprise a plurality of squares as shown in FIGS. 4 or 6 may be used.

Figure 7:
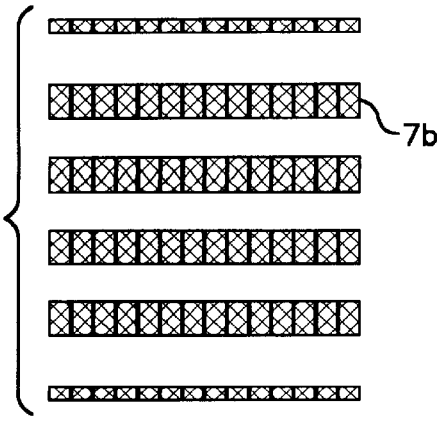
FIG. 7 is a diagram which shows the coating pattern of the adhesive applied to the workpiece.

The adhesive 4 that remains and only fills the patterned hollows of the first roll 1 is transferred to just the surface of the patterns of protrusions 2*a* or 2*b* of the second roll 2 which rotates while in contact with the first roll 1. Here, a workpiece 7 translates into contact with the second roll 2 by a pressure roller 6, which presses the workpiece 7 into contact with the second roll 2. Thus, adhesive 4 is transferred from the surface of the second roll 2 to the surface of the workpiece 7 in the condition indicated by coating pattern 7*a*, as shown in FIG. 2, or as indicated by coating pattern 7*b* as shown in FIG. 7, which consists of a combination of the first pattern and the second pattern. Furthermore, the workpiece 7 on which the coating pattern 7*a* or 7*b* has been formed, is passed together with a bonding material 8 through a pair of nip rolls 9, and thereby the workpiece 7 is bonded with the bonding material 8.

In the present invention, the net-like pattern 1*a* of hollows formed on the first roll 1 and the pattern of protrusions 2*a* or 2*b* in rectangular or square form formed on the second roll 2 were combined, and it is also possible to combine patterns, designs, letters, symbols, or pictures that are formed by the patterned hollows of the first roll with similar patterns, designs, letters, symbols, or pictures that are formed by the patterned protrusions of the second roll 2.

In the device used in the conventional technique, it is necessary to remove the tank 30 that contains the hot melt adhesive 27 and also to exchange the first roll 31 which has been provided with a pattern of hollows with another roll in order to change the coating pattern. On the other hand, to change the coating pattern in the device of the present invention, it is of course possible to exchange both the first and second rolls with other rolls, but by allowing the pattern of hollows of the first roll to work in conjunction with the pattern of protrusions of the second roll, the coating pattern can be changed by changing only the pattern of protrusions of the second roll. This latter possibility in accordance with the present invention allows the number of steps needed to change the coating pattern and the cost of the device to be less than those of devices used in the conventional technique.

For the purpose of applying a hot melt adhesive 4 to a workpiece 7, the present invention makes it clearly possible to apply an adhesive without destroying the shape of the coating pattern and without causing stains to adhere to areas other than the area of the coating pattern whenever elaborate and fine coating patterns are used. Furthermore, because the force with which the doctor blade 5 is pressed against the first roll 1 can be reduced, the service life of the doctor blade 5 and first roll 1 can be extended. Moreover, the use of the protrusions 2*a* or 2*b* of the second roll 2 in the transfer process makes the transfer possible until the protrusions disappear, even if there is minor peeling of the second roll surface material due to the adhesive, consequently an extension of the service life of the second roll 2 can also be expected.

To solve the above-mentioned problems, hollows that make up a first pattern are formed on the surface of the first roll, and at the same time protrusions of a second pattern are also formed on the surface of the second roll which is used to transfer the adhesive that fills up the hollows of the first roll onto the workpiece by rotating while in contact with the first roll. When this approach is adapted, the adhesive is only transferred onto the protrusions of the second roll even when there is an excess of adhesive filling up the hollows of the first roll and even when the adhesive is left in areas other than the hollows; the consequence of this is to prevent stains from being transferred to the workpiece. Moreover, the necessary and sufficient amount of adhesive is transferred to obtain elaborate, fine, and clear patterns that retain their shape.

Furthermore, a complicated adhesive coating pattern can easily be formed, because two types of patterns can be combined. What is more, the force with which the doctor blade is pressed against the first roll can be decreased, because the above-mentioned effect reduces the need to intensively scrape off excess adhesive from the hollows of the first roll. An advantage is therefore gained in that the service life of the first roll and doctor blade is extended.

In the conventional technique, because of the formation of hollows upon the repeated transfer of the adhesive onto the flat surface of the second roll due to peeling, the possibility of early failure exists with regard to the transfer coating of the pattern. However, when the protrusions of the pattern are formed on the surface of the second roll, the pattern can be transferred with certainty until the protrusions disappear, even when there is peeling of the surface material of the second roll due to the transfer process.

If a net-like pattern 1*a* on the first roll 1 is transfer-coated onto a workpiece 7 with the use of a second roll with a flat surface, as in the conventional technique, there will most likely be spreading and/or smearing unless the pressing force is increased. In accordance with this actual example, the pressing pressure of the doctor blade can be further decreased, and it has been confirmed that wear of the first roll and the doctor blade can be substantially reduced as compared with the conventional technique, i.e., it is clearly possible to extend the service life.

Figure 8:
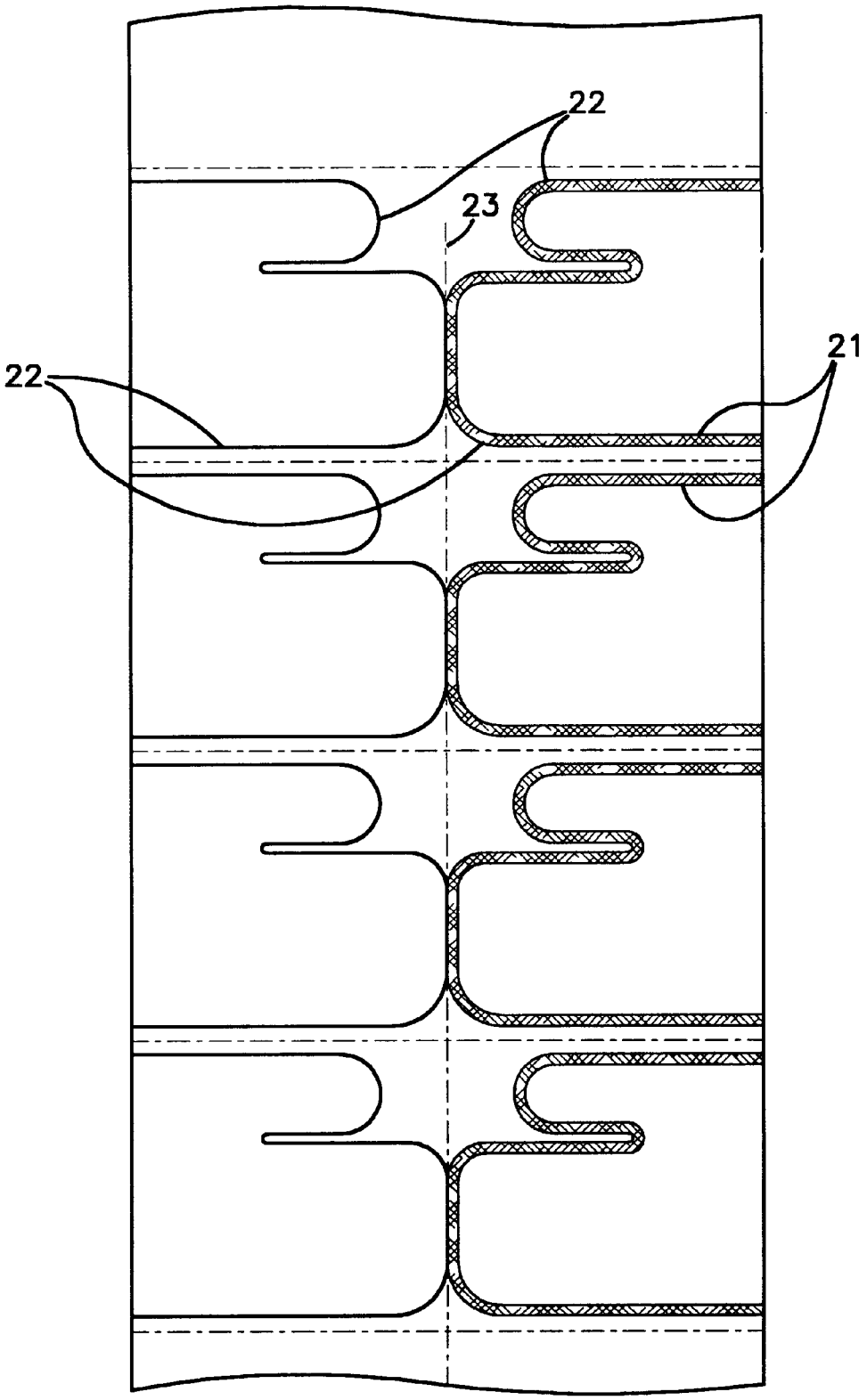
FIG. 8 is a specific example of a coating pattern on a workpiece coated with an adhesive according to the present invention.

An actual example of the present invention will now be described for preparing glove-shaped disposable cleaning accessories that can be used for wiping areas with curved surfaces, such as washstands or bathtubs. FIG. 8 shows a specific example of a coating pattern on a workpiece transfer-coated with an adhesive. The workpiece shown in the figure is, for example, a fibrous nonwoven fabric with flexibility and elasticity, and the adhesive is transfer-coated onto adhesive coating zone 21 of this workpiece. The workpiece is cut along a cutting line 22 and then the workpiece is folded along a folding line 23 and bonded to form a glove-shaped article.

This article must maintain the greatest amount possible of the flexibility and elasticity of the material if it is to remain suitable for use on curved surfaces. To meet this requirement the adhesive must be applied in an elaborate and fine pattern and yet a large number of voids or uncoated areas must remain in the adhesive coating region. The present invention can be used for the application of the adhesive and the bonding of the base material in a manner that will satisfy this requirement. The present invention is not limited to the above-mentioned example. For example, the present invention can presumably be used satisfactorily in the manufacture of various articles by the sticking together of more than one base material while maintaining their properties, especially with respect to base materials with flexibility and elasticity.

In this actual example, excluding the area on which the pattern was formed, none of the remaining surface was stained with the adhesive 4 after the coating pattern 7*a* or 7*b* was formed on the adhesive coating surface 21 of the workpiece 7. Furthermore, the adhesive 4 was transferred very clearly and without losing its shape, in spite of its elaborate and fine pattern. The pressing force of the doctor blade 5 was not increased even though the pattern was elaborate and fine.

Although the invention has been disclosed and described with respect to certain preferred embodiments, certain variations and modifications may occur to those skilled in the art upon reading this specification. Any such variations and modifications are within the purview of the invention notwithstanding the defining limitations of the accompanying claims and equivalents thereof.

I claim:

1. An apparatus for applying an adhesive to a workpiece comprising:

a tank for holding an adhesive, a first roll having a patterned outer surface with hollow areas formed therein;

means for mounting said first roll within said tank in a position to at least partially immerse said first roll in the adhesive;

means for rotating said first roll within said tank and filling said hollow areas with the adhesive;

a second roll having a plurality of protrusions extending from the surface thereof, said second roll being rotatably mounted so that only said protrusions of said second roll are in fluid contact with the adhesive within said hollow areas of said first roll; and means for moving, said second roll and the workpiece relative to each other and for transferring the adhesive from said protrusions to said second roll onto the workpiece.

2. The device in claim 1 in which the first roll has a surface having a first pattern, and said second roll has a surface having a second pattern, said second pattern being different than said first pattern.

3. The device in claim 1 wherein said pattern comprises a plurality of square protrusions.

4. A method for applying an adhesive to a workpiece comprising the steps of:

filling with adhesive the hollows of a patterned outer surface of a first roll;

transferring the adhesive from the hollows of said first roll onto a plurality of protrusions extending from a surface of a second roll by bringing only the protrusions of the second roll into fluid contact with adhesive within the hollows of the first roll; and transferring the adhesive from said protrusions of said second roll onto the workpiece by bringing the protrusions of the second roll into contact with said workpiece.

5. The method of claim 4 wherein said filling step further comprises filling with adhesive the hollows of a patterned outer surface of a rotating first roll partially immersed in adhesive.

6. The method of claim 4 wherein said first transferring step further comprises transferring the adhesive from the hollows of said first roll onto the surface of a rotating second roll when said second roll is brought into contact with said first roll, with the second roll surface having patterned protrusions.

7. The method of claim 4 wherein said second transferring step further comprises transferring the adhesive from said protrusions of said second roll to the surface of a workpiece to be coated by moving said workpiece into contact with said second roll while under pressure.

* * * * *

UNITED STATES PATENT AND TRADEMARK OFFICE

CERTIFICATE OF CORRECTION

PATENT NO. : 6,074,480
DATED : June 13, 2000
INVENTOR(S) : Watura Kakuta

It is certified that error appears in the above-identified patent and that said Letters Patent is hereby corrected as shown below:

Column 6.
Lines 25-26, cancel claim 3.
Line 55, add claim 8 as follows -- The method of claim 4 wherein second transferring step further comprises transferring the adhesive from the protrusions of the second roll to the surface of a workpiece to be coated by moving and pressing the workpiece into contact with the second roll using a pressure roll. --
Line 19, please delete "to" and insert -- of --;
Line 21, please delete "device" and "the" and insert -- apparatus -- and -- said --, respectively;
Line 31, please delete "said" and insert -- the --;
Line 36, please delete both occurrences of "said" and replace with -- the --;
Line 38, please delete "said" and insert -- the --;
Line 40, delete "said" and insert -- the --;
Line 44, delete "said" and insert -- the --;
Line 46, delete "said" and insert -- the --;
Line 47, delete both occurrences of "said" and replace with -- the --;
Line 50, delete "said" and insert -- the --;
Line 51, delete "said" and insert -- the --;
Line 52, delete "said" and insert -- the --;
Line 53, delete both occurrences of "said" and replace with -- the --;

Signed and Sealed this

Eleventh Day of September, 2001

*Attest:*

Nicholas P. Godici

*Attesting Officer*

NICHOLAS P. GODICI
*Acting Director of the United States Patent and Trademark Office*